US011505928B2

(12) United States Patent
Benstead

(10) Patent No.: US 11,505,928 B2
(45) Date of Patent: Nov. 22, 2022

(54) WETTED SPOUT FAUCET AND CARTRIDGE SEAT ASSEMBLY FOR THE SAME

(71) Applicant: Spectrum Brands, Inc., Middleton, WI (US)

(72) Inventor: Evan Benstead, Los Angeles, CA (US)

(73) Assignee: Spectrum Brands, Inc., Middleton, WI (US)

( * ) Notice: Subject to any disclaimer, the term of this patent is extended or adjusted under 35 U.S.C. 154(b) by 0 days.

(21) Appl. No.: 17/025,056

(22) Filed: Sep. 18, 2020

(65) Prior Publication Data

US 2021/0087800 A1 Mar. 25, 2021

Related U.S. Application Data

(60) Provisional application No. 62/902,777, filed on Sep. 19, 2019.

(51) Int. Cl.
*E03C 1/04* (2006.01)

(52) U.S. Cl.
CPC ..... *E03C 1/0403* (2013.01); *E03C 1/0404* (2013.01)

(58) Field of Classification Search
CPC ..... E03C 1/0403; E03C 1/0404
See application file for complete search history.

(56) References Cited

U.S. PATENT DOCUMENTS 5,361,431 A * 11/1994 Freier ..... E03C 1/0401 137/218
5,396,929 A * 3/1995 Rodriguez ..... E03C 1/04 137/801
5,934,325 A * 8/1999 Brattoli ..... E03C 1/0404 4/678
6,481,759 B1 * 11/2002 Kawasaki ..... F16L 37/0985 285/319
7,415,991 B2 * 8/2008 Meehan ..... E03C 1/0404 137/801
9,791,060 B2 * 10/2017 Chiu ..... E03C 1/0412
2004/0010848 A1 * 1/2004 Esche ..... E03C 1/04 4/675
2012/0018020 A1 * 1/2012 Moore ..... E03C 1/0403 137/798
2014/0015243 A1 * 1/2014 King ..... E03C 1/021 285/8
2016/0061338 A1 * 3/2016 Rowe ..... F16K 11/078 137/625.17
2018/0266088 A1 * 9/2018 Zhuo ..... E03C 1/0412
2020/0123741 A1 * 4/2020 Huang ..... E03C 1/0404

* cited by examiner

*Primary Examiner* — Patrick C Williams
(74) *Attorney, Agent, or Firm* — Merchant & Gould P.C.

(57) ABSTRACT

A faucet includes a faucet body and a spout attached to the faucet body and extending from the faucet body along an axis. The spout has an interior defining a fluid path. A cartridge seat is positioned within the faucet body and contacts a valve cartridge positioned offset from the axis. The valve cartridge is fluidically connected to the cartridge seat. A flexible tube fluidically connects between a fluid outlet of the cartridge seat and the spout, and is positioned entirely within a cavity formed by the faucet body and the spout.

15 Claims, 11 Drawing Sheets

WETTED SPOUT FAUCET AND CARTRIDGE SEAT ASSEMBLY FOR THE SAME

CROSS REFERENCE TO RELATED APPLICATION

This application claims the benefit of U.S. Provisional Application Ser. No. 62/902,777, filed Sep. 19, 2019, the disclosure of which is hereby incorporated by reference in its entirety.

TECHNICAL FIELD

The present invention generally relates to construction of faucets, and more particularly to a cartridge seat assembly for a wetted spout faucet.

BACKGROUND

There are a variety of different types of faucets, including a J-spout type faucet, spray head faucets, wetted tube faucets, etc. Such faucets can have a variety of fluid inlet and outlet routing paths. Typically, two inlet lines, one hot and one cold, are routed into a cartridge seat contained within a faucet body from fluid supply lines. In the case of wetted tube faucets where the spout is rigidly attached to the faucet body, the cartridge seat and cartridge seat outlet are not directly connected to the wetted spout because both the spout center axis and the handle gap to the faucet body need to be located with a degree of precision requiring impractical manufacturing tolerances. Therefore, a third tube, e.g. an outlet tube, is routed from the outlet of the cartridge seat and extends out of the faucet body in the direction of the two inlet lines, e.g. below the sink on which the faucet is mounted. A fourth tube is then connected to the outlet tube and is integrated into the wetted spout. The fourth tube occupies a volume within the faucet body limiting faucet body design, and a user or installer has to connect the third tube to the fourth tube during installation.

Therefore, there is a need for improvements in the fluid routing of faucets having wetted spouts, particularly wetted spouts that are rigidly attached to the faucet body.

SUMMARY

In general terms, this disclosure is directed towards a means and system of connecting a faucet cartridge to a wetted spout by a flexible tube.

In a first aspect, a faucet includes a faucet body and a spout attached to the faucet body. The spout extends from the faucet body along an axis, the spout having an interior defining a fluid path. The faucet includes a cartridge seat positioned within the faucet body, the cartridge seat having a fluid inlet and a fluid outlet. The faucet further includes a valve cartridge positioned offset from the axis and contacting the cartridge seat, the valve cartridge being fluidically connected to the cartridge seat, forming a fluid path between the fluid inlet and the fluid outlet. The faucet also includes a flexible tube fluidically connected between the fluid outlet of the cartridge seat and the spout, the flexible tube is positioned entirely within a cavity formed by the faucet body and the spout.

In a second aspect, a cartridge seat assembly includes a cartridge seat configured to be attached to a faucet body and a valve cartridge, as well as one or more inlet lines attached to the inlet of the cartridge seat. The cartridge seat assembly includes a flexible tube having a first end attached to an outlet of the cartridge seat, the flexible tube configured to be slidably attached within a faucet spout.

In a third aspect, a faucet includes a substantially vertically oriented faucet body, a valve cartridge mounted within the faucet body and oriented along a non-vertical axis, a rigid spout rotatably attached to the faucet body, the rigid spout having an interior defining a fluid path, and a cartridge seat assembly. The cartridge seat assembly includes a cartridge seat configured to be attached to the faucet body and the valve cartridge, one or more inlet lines attached to the inlet of the cartridge seat, and a flexible tube having a first end attached to an outlet of the cartridge seat and a second end in fluid communication with the rigid spout.

In a further aspect, a faucet includes a faucet body, a spout attached to the faucet body at a mounting channel and extending from the faucet body along an axis, and a cartridge seat positioned within the faucet body, the cartridge seat having a fluid inlet and a fluid outlet. The faucet further includes a valve cartridge positioned offset from the axis and contacting the cartridge seat, the valve cartridge being fluidically connected to the cartridge seat, forming a fluid path between the fluid inlet and the fluid outlet. The faucet further includes a flexible tube extending generally linearly between the fluid outlet of the cartridge seat and toward the mounting channel and fluidically connecting the fluid outlet of the cartridge seat to the spout.

Corresponding reference characters indicate corresponding parts throughout the several views. The exemplifications set out herein illustrate an embodiment of the invention, and such exemplifications are not to be construed as limiting the scope of the invention in any manner.

BRIEF DESCRIPTION OF THE DRAWINGS

The present disclosure will be described hereafter with reference to the attached drawings which are given as non-limiting examples only, in which.

DETAILED DESCRIPTION

Figure 1:
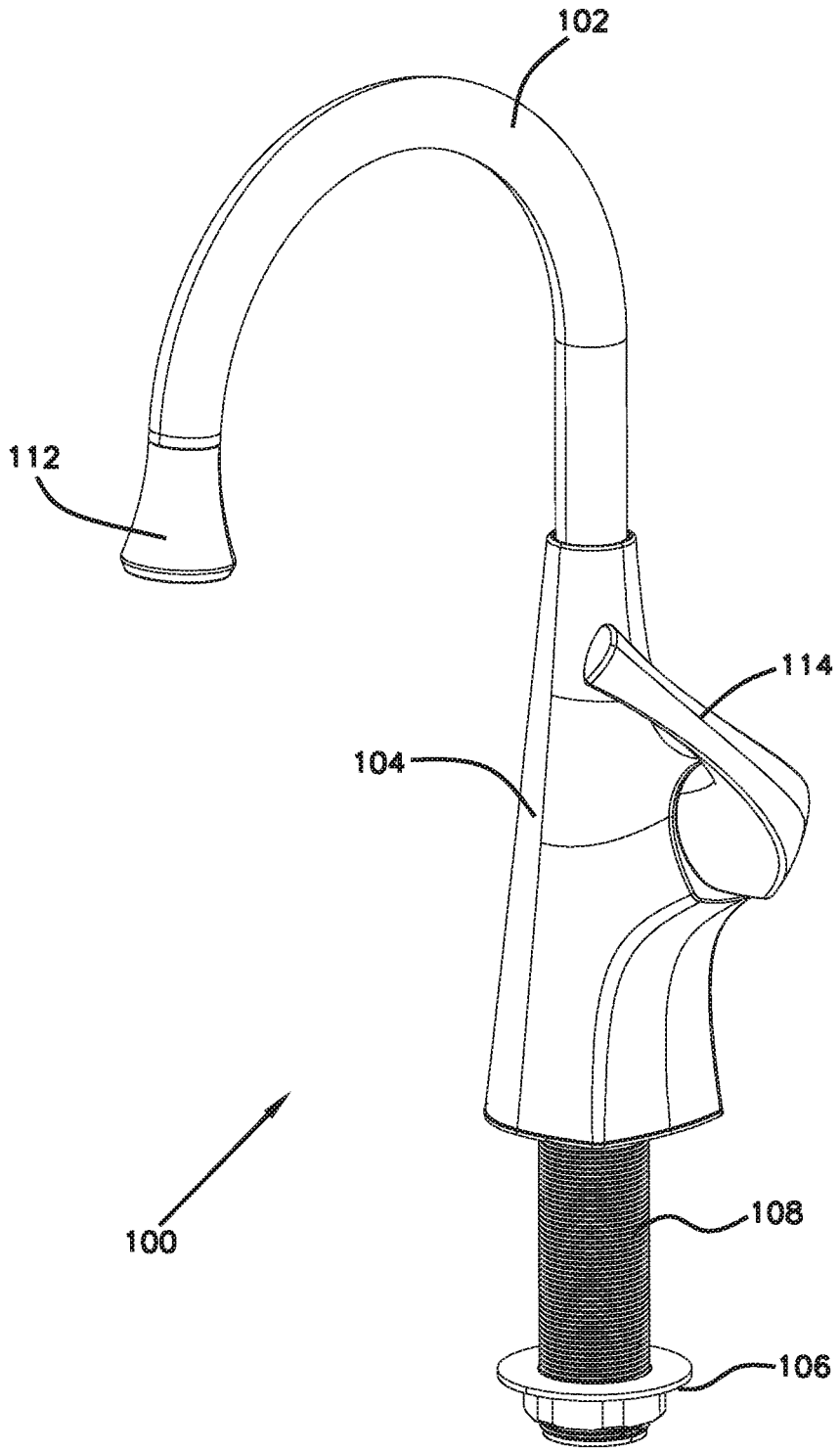
FIG. 1 is a front perspective view of an example wetted spout faucet, in accordance with some embodiments of the present disclosure.

The figures and descriptions provided herein may have been simplified to illustrate aspects that are relevant for a clear understanding of the herein described devices, systems, and methods, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations are well known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. Additionally, it should be appreciated that items included in a list in the form of "at least one A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C).

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features.

This disclosure relates generally to faucet hardware. For example, this disclosure may relate, in some embodiments, to a J-spout, wetted tube faucet having at least one integrated cartridge. In general, such a wetted tube faucet has a spout that defines a waterway defined by its interior surface, rather than having a separate hose passing through an interior of the body of a spout tube. Additionally, in embodiments discussed herein, water flow to such a spout is controlled by a cartridge mounted directly to a body of the faucet from which the spout extends (e.g., rather than being positioned spaced apart from the body). In such cases, manufacturing tolerances may vary the distance between the mounting position of the cartridge and the position of the spout.

Accordingly, in some embodiments, a cartridge seat module is an assembly including a cartridge seat, inlet tubes, and a flexible outlet tube. The cartridge seat can be attached to the faucet cartridge, the inlet lines attached to the supply lines, and the flexible tube can be inserted directly into the faucet spout, e.g., the wetted spout. The flexible outlet tube relaxes the precision of the location of the cartridge seat outlet axis relative to the axis of the wetted spout by providing a flexible connection between the cartridge seat outlet and the spout. Such a cartridge seat module is more compact and eliminates the need to connect a fourth tube between a cartridge seat outlet tube and the faucet spout, enabling expanded faucet design options and reducing installation time and cost.

Referring to FIG. 1, an example faucet 100 is shown. As illustrated, the faucet 100 includes a spout 102 that is configured to be mounted to a faucet body 104. In the embodiment shown, the faucet body 104 is configured to be mounted on the surface of a sink top or countertop (not shown), for example, via tightening a mounting nut 106 on a threaded post 108 underneath the sink top or countertop. The threaded post 108 is a generally hollow cylindrical post through which fluid supply lines may extend into the faucet body 104 from below a sink top or countertop. The spout 102 is mounted to the faucet body 104, and extends upward from a surface of a sink top or countertop, optionally including a bent or rounded portion leading to a spout head 112 from which fluid is dispensed.

In the embodiment shown, the faucet 100 is a wetted spout faucet. This generally means that the spout 102 has an interior cavity that defines a fluid path, such that fluid is in direct contact with an interior surface defining the interior cavity rather than the interior cavity hosting a spout tube.

In the embodiment shown, the faucet 100 includes a faucet handle 114 which is engaged to a cartridge, described in greater detail below in conjunction with FIGS. 2-12. Generally, the faucet handle 114 allows for manipulation of a valve within a cartridge to control flow rate of fluid output from the cartridge based on receipt of hot and cold fluid lines (seen in FIGS. 5-6), thereby controlling both flow rate and overall temperature of an output fluid stream.

Figure 2:
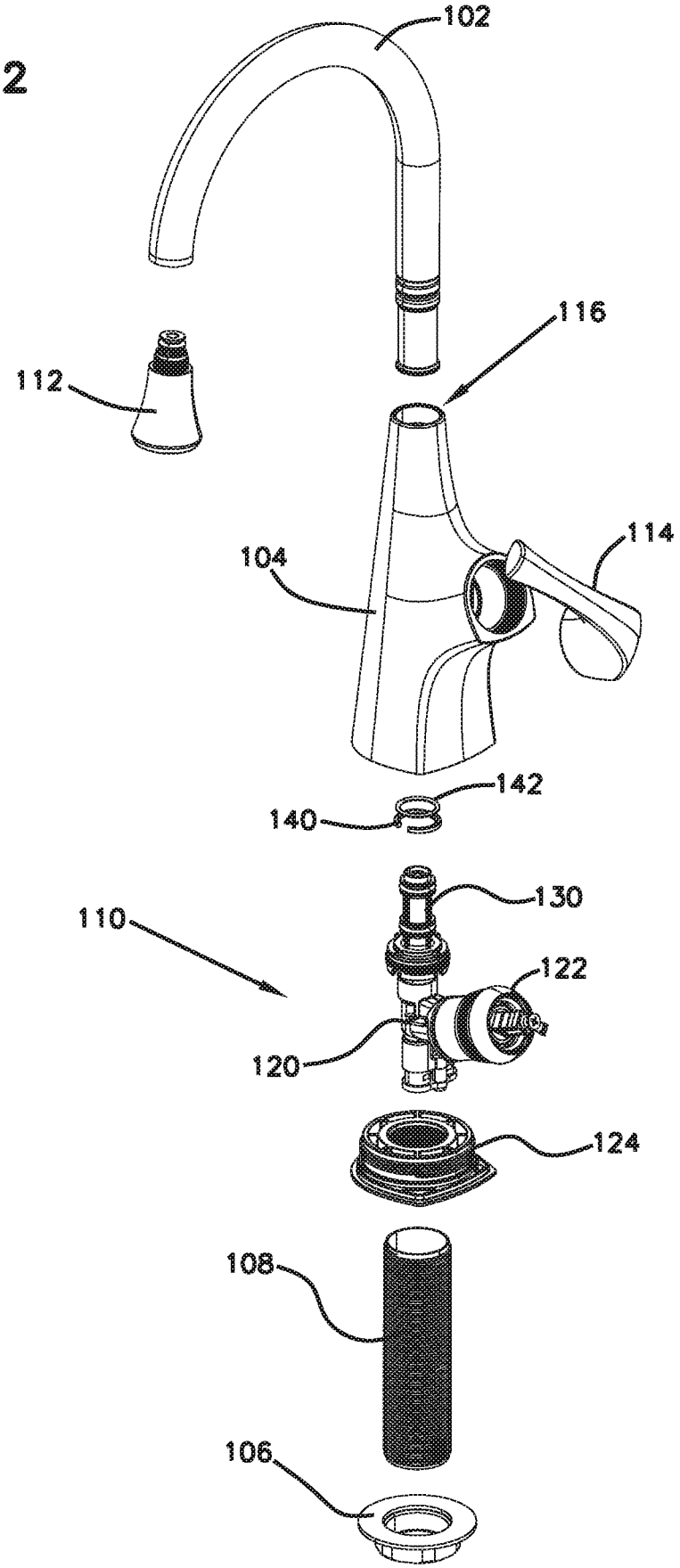
FIG. 2 is an exploded perspective view of the wetted spout faucet of FIG. 1.

Referring now to FIG. 2, an exploded perspective view of an example wetted spout faucet 100 is shown, in accordance with some embodiments of the present disclosure. In the example shown, the faucet 100 includes a cartridge seat assembly 110 including a cartridge seat 120 configured to be attached to a cartridge 122, and a spout bearing 130.

As described in further detail below, the cartridge seat 120 is fixedly attached to the cartridge 122, and a flexible tube extends from the cartridge seat 120 to the spout bearing 130 to accommodate variable relative positioning between the spout bearing 130 and cartridge seat 120. Details regarding the cartridge seat assembly, and its interconnection to the cartridge 122 and spout bearing 130, are described in further detail below in conjunction with FIGS. 5-6.

In the example shown, the cartridge 122 is configured to be mounted to the faucet body 104 and the cartridge seat 120 via the threaded post 108. The faucet handle 114 is configured to be attached to the cartridge 122. In some embodiments, the cartridge 122 controls the flow rate of each of the inlet lines, thereby controlling the ratio of fluid from both the inlet lines and the overall flow, e.g., both temperature and flow rate of the fluid.

Additionally, although in the embodiment shown a single cartridge 122 is depicted, it is recognized that, in alternative embodiments, more than one cartridge could be included within such a faucet and be mountable to the faucet body 104.

The spout bearing 130 is generally positioned coaxial with a portion of the spout 102, while the position of the cartridge seat 120 varies based on positioning of the cartridge 122. In the example shown, the spout bearing 130 is configured to be attached to the faucet body 104, e.g., via a threaded retainer ring, and to be inserted within the spout 102. Further details regarding the spout bearing 130 are illustrated and described below.

In the embodiment shown, a retaining clip 140 retains the spout 102 when the spout 102 is received by the faucet body 104. In some embodiments, the spout 102 is rigidly and rotatably mounted to the faucet body 104 by way of the retaining clip 140 and an o-ring 142, as discussed in conjunction with FIG. 9, below. In the example shown, the spout 102 is configured to be inserted into a mounting channel 116, e.g., a spout aperture, in the faucet body 104, allowing the spout to rotate along the axis of insertion into the mounting channel while being retained by the faucet body 104.

A faucet base 124 encloses the cartridge seat assembly 110 within the faucet body 104, and receives the threaded post 108. The faucet base 124 is fitted within the spout 102 and therefore is obscured from view when the faucet is mounted to a countertop or sink top. The faucet base includes a threaded opening that receives the threaded post 108, such that the faucet is mounted to a countertop or sink top securely by inserting the threaded post 108 through a hole in the countertop or sink top and tightening the mounting nut 106 on the threaded post toward the faucet base 124.

Figure 3:
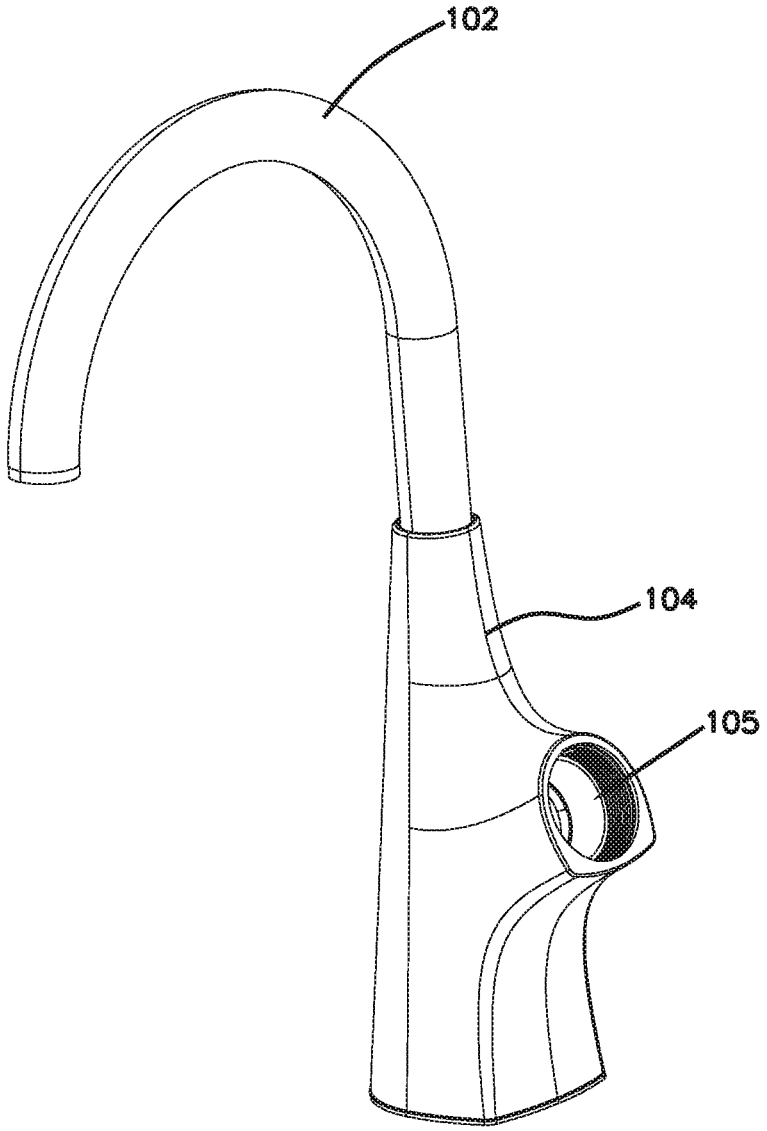
FIG. 3 is a front perspective view of the spout and faucet body of the faucet of FIG. 1.

FIG. 3 is a front perspective view of the spout 102 and faucet body 104 of an example wetted spout faucet, in accordance with some embodiments of the present disclosure. As seen in FIG. 3, the cartridge 122 is mountable within the faucet body by inserting the cartridge into a cartridge opening 105 within the faucet body 104. In the example shown, the cartridge opening 105 has a threaded inner surface, allowing the cartridge to be received into a fixed position within the faucet body 104 by utilizing a screw-down gasket that laterally surrounds the cartridge, seen in FIG. 4. Once in the fixed position, the faucet handle 114 may be affixed to the cartridge 120 for controlling position of valves within the cartridge 122.

Figure 4:
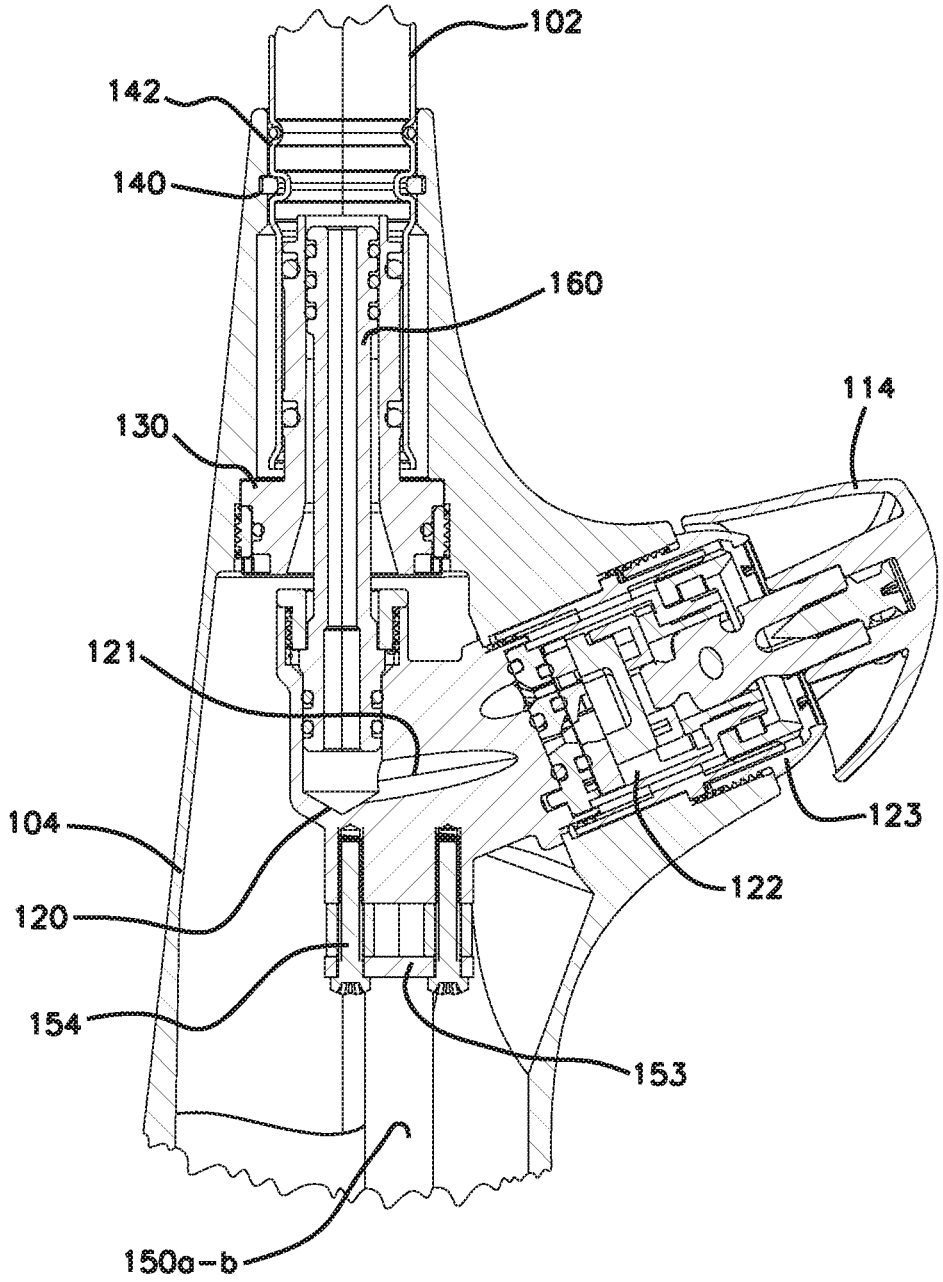
FIG. 4 is a cross-sectional perspective view of a portion of the wetted spout faucet of FIG. 1

FIG. 4 is a cross-sectional perspective view of a portion of the faucet 100 of FIG. 1. Generally, the cross-sectional perspective view of the faucet 100 illustrates an interior construction of the faucet, including interconnections among the cartridge 122, cartridge seat assembly 110, faucet body 104, and spout 102.

As illustrated in FIG. 4, the spout 102 is inserted into mounting channel 116 of the faucet body 104, and retained by the expandable retaining clip 140. An o-ring 142 is positioned between the spout 102 and an interior surface of the mounting channel 116 to provide a bearing surface allowing smooth pivotal movement of the spout 102 relative to the faucet body 104. Although one o-ring and one retaining clip are shown, it is recognized that more than one such o-ring or more than one such retaining clip can be used.

The cartridge 122 is inserted through the threaded opening and fixed into place by a surrounding retaining nut 123. The retaining nut 123 engages with the threaded interior surface of the threaded cartridge opening 105 to retain the cartridge in place. Although in the embodiment shown, the retaining nut 123 encircles the cartridge 122 and provides a sealing connection at a base of the cartridge; in other embodiments, the retaining nut 123 may only partially encircle the cartridge 122. Once installed, the faucet handle 114 may be attached to the cartridge to allow a user to manipulate a valve position of the cartridge.

When the cartridge 122 is inserted in an aligned position, it contacts the cartridge seat 120. As seen in further detail in FIGS. 5-6, the cartridge seat assembly 110 includes a cartridge seat 120 that receives fluid supply tubes 150*a-b* into a lower portion, which extend into the faucet body 104 through the faucet base 124 (not shown). A fluid path is defined from the fluid supply tubes 150*a-b,* into the cartridge seat 120, and to the cartridge 122. A single outlet channel 121 fluidically connects an outlet side of the cartridge 122, through the cartridge seat 120 to a fluid outlet side 152 of the cartridge seat 120.

It is noted that the cartridge 122 is mounted within the faucet body 104, and in particular, at a position that is not in direct alignment with the spout 102. Because manufacturing tolerances may result in a varying distance between a center axis of the spout 102 as it enters the faucet body 104 and the cartridge 122 and associated cartridge seat 120, a flexible tube 160 extends between and fluidically connects the fluid outlet side 152 of the cartridge seat 120 to the spout 102 via a sealing connection to both the cartridge seat 120 and the spout bearing 130.

In particular, in the embodiment shown, the flexible tube 160 includes sealing ends having o-rings 161 on an outer peripheral surface, and extends generally linearly between the fluid outlet of the cartridge seat 120 and toward the mounting channel 116, and fluidically connects the fluid outlet side 152 of the cartridge seat to the spout 102. In the embodiment shown, a first end that forms a sealing connection to the fluid outlet side 152 of the cartridge seat 120 has two o-rings, while a second end forming a sealing connection to an interior surface of the bearing 130 has three o-rings; however, in alternative embodiments, other numbers or types of sealing structures may be used.

In the example seen in FIG. 4, and as further illustrated below, the fluid outlet side 152 of the cartridge seat 120 is threaded, and receives a threaded nut 162 that engages with a flange of the flexible tube 160 to retain the first end of the flexible tube in place within the outlet side 152. Pressure applied on the flange of the flexible tube 160 by the threaded nut 162 presses the flanged end of the flexible tube 160 against a ramped surface within the fluid outlet side 152 of the cartridge seat assembly 120, thereby strengthening the sealing connection therebetween. As noted above, two o-rings 161 contribute to the sealing connection between the fluid outlet side 152 and the flexible tube 160 as well. An opposite end of the flexible tube 160 extends upward and into the bearing 130. The flexible tube forms a sealing connection against an interior surface of the bearing 130 via o-rings 161.

Figure 9:
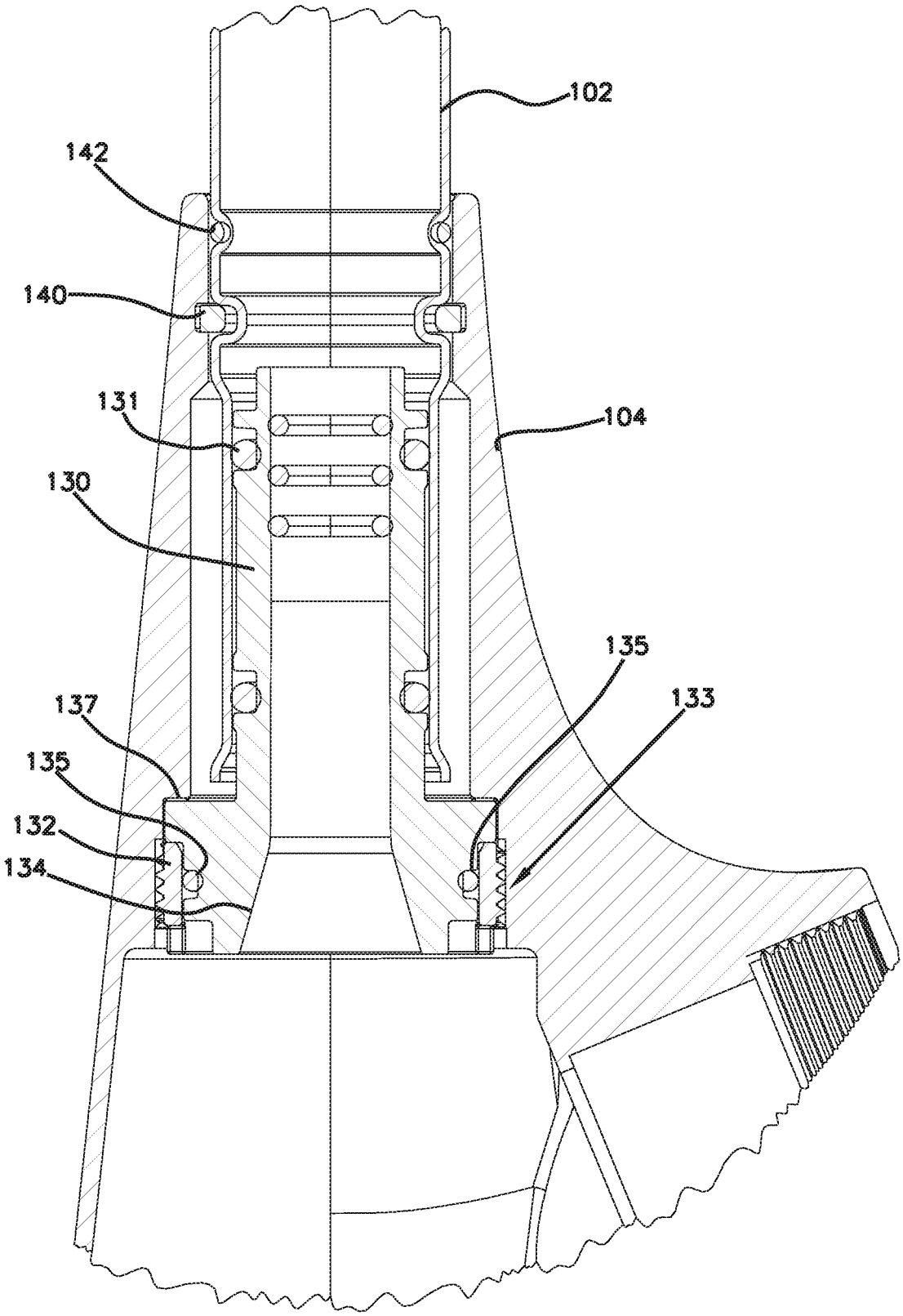
FIG. 9 is a cross-sectional perspective view of the spout bearing of FIG. 8.
Figure 10:
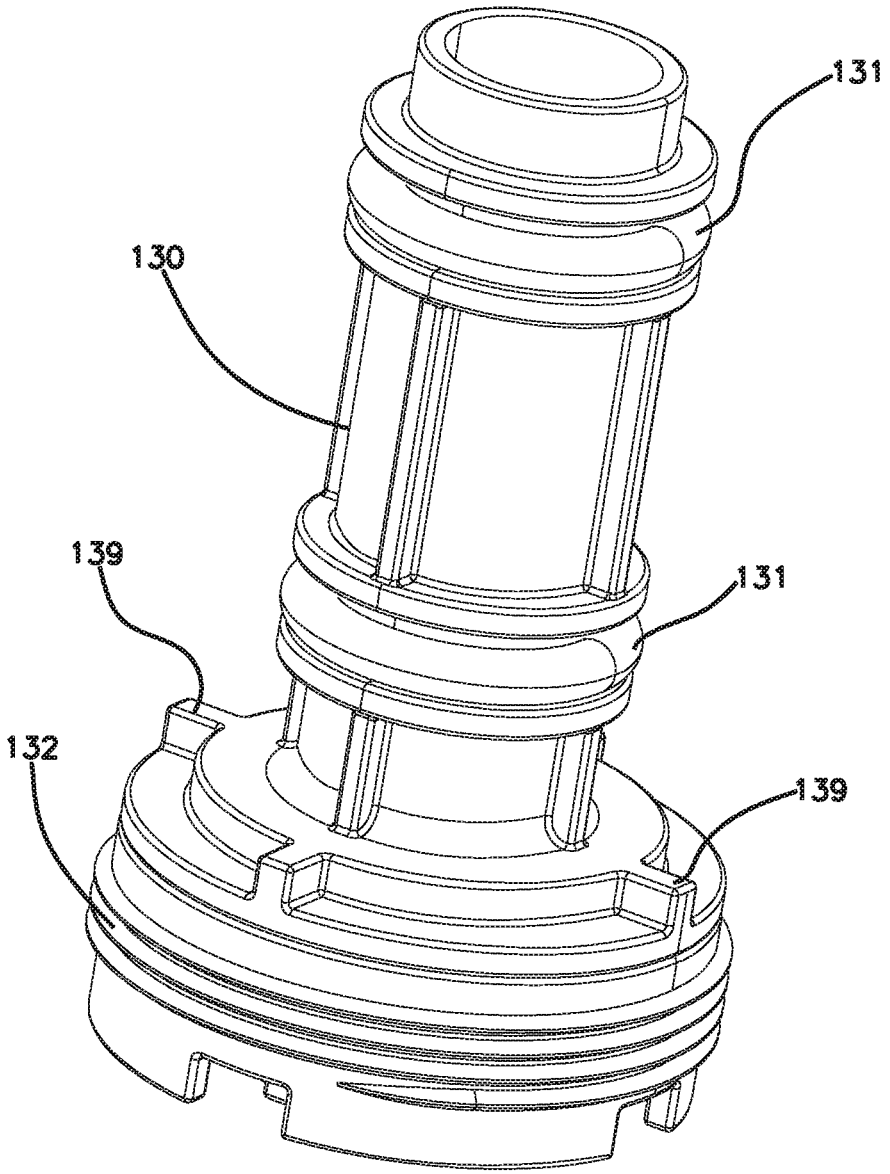
FIG. 10 is a perspective view of the spout bearing of FIG. 8.
Figure 11:
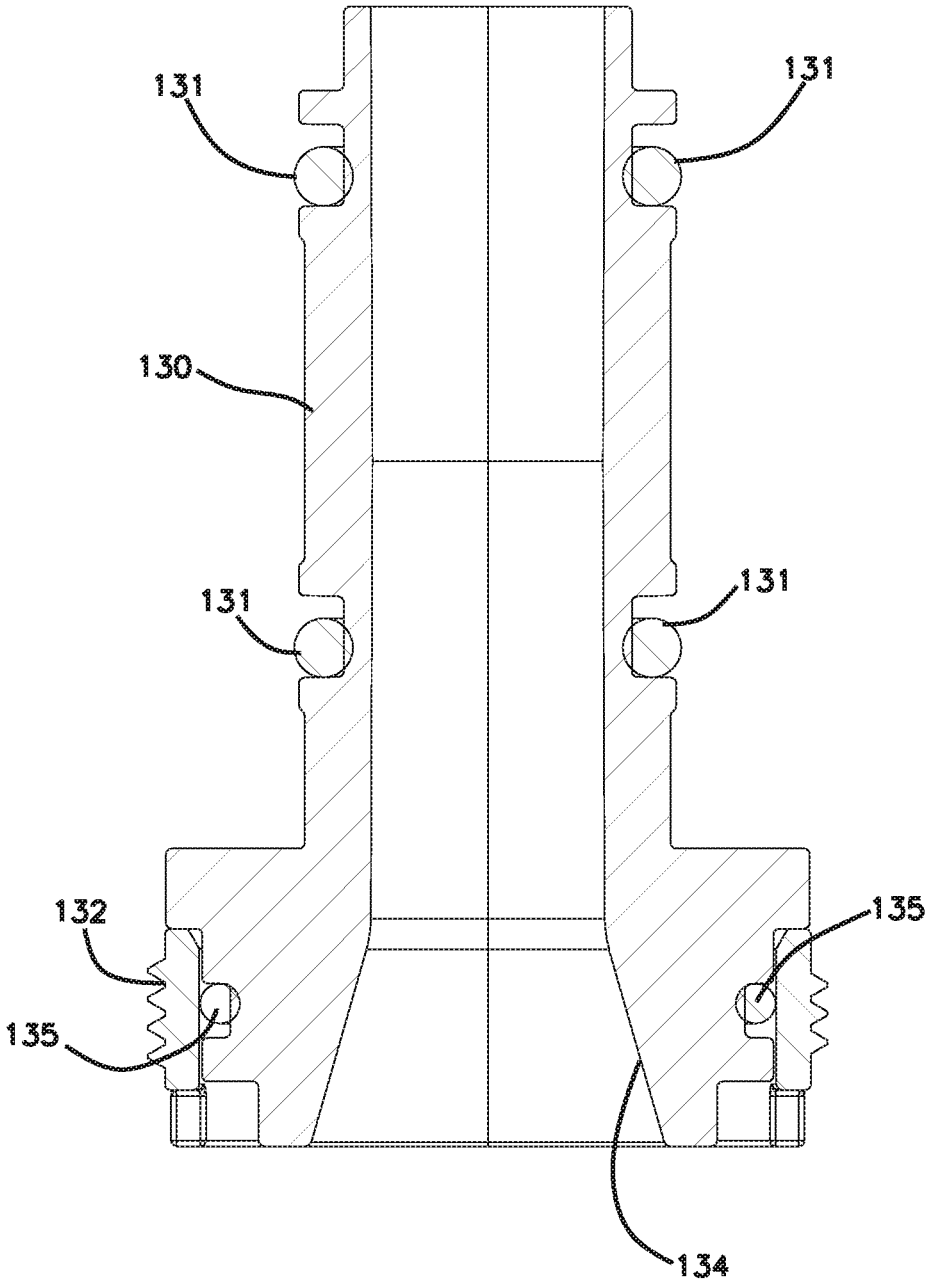
FIG. 11 is a cross-sectional perspective view of the spout bearing of FIG. 8.

As seen in FIG. 4 and in further detail in FIG. 9, the bearing 130, as mentioned previously, extends upwardly within the faucet body 104 and into an area within an interior of the spout 102. The bearing 130 forms a sealing connection against an interior surface of the spout 102 via o-rings 131. In some examples, a dynamic sealing arrangement is formed between the spout 102 and the bearing 130 so that the spout 102 can be rotated with respect to the body 104. The bearing 130 is held in place by a threaded collar 132 (also referred to as a threaded retainer ring) which engages a receiving surface 133 of the faucet body 104 that is positioned below the mounting channel 116 that receives the spout 102. An o-ring 135 is compressed between the threaded collar 132 and bearing to form a seal between the bearing and the faucet body 104 at the location of the receiving surface 133 Accordingly, and as explained further below, the bearing 130 is rotatably affixed to the faucet body 104, allowing the spout 102 to be pivotable around a central axis.

In the example shown in FIG. 4 (and seen in further detail in FIG. 9), the bearing 130 has an interior ramped surface 134 at the entry point at which the flexible tube 160 is inserted. The ramped surface guides the flexible tube 160 into the bearing and accommodates a slight bend in the flexible tube 160 that may occur due to misalignment of the fluid outlet side 152 of the cartridge seat 120 with a central axis of the spout 102.

In the arrangement as shown, the flexible tube 160 is positioned entirely within a cavity formed by the faucet body 104 and the spout 102. In some examples, the flexible tube 160 is positioned entirely within the faucet body 104 and does not extend upwardly into the spout 102, but rather only extends as far as the bearing 130. In the various embodiments, the flexible tube 160 does not extend downward below the countertop or sink top, which would involve additional fluid conduit routing complexity.

Figure 5:
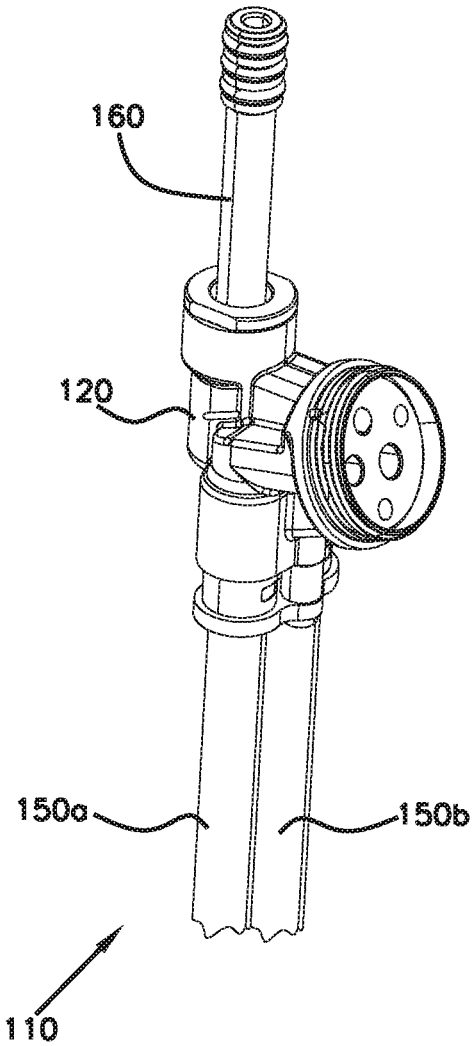
FIG. 5 is a perspective view of an example cartridge seat module usable within the faucet of FIG. 1
Figure 6:
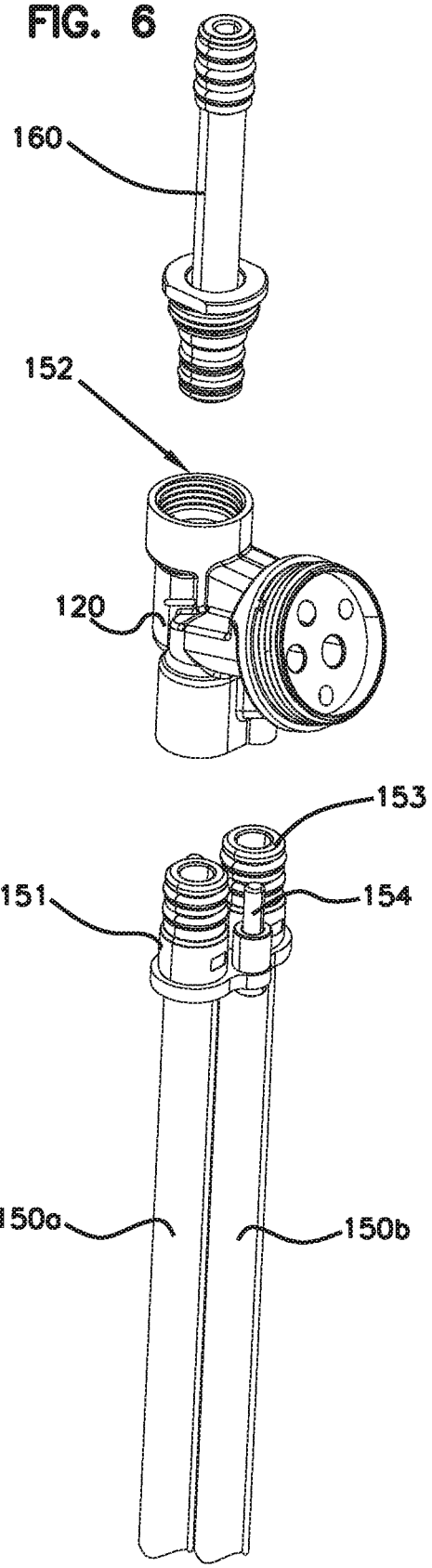
FIG. 6 is an exploded perspective view of the example cartridge seat module of FIG. 5.

Referring now to FIGS. 5-6, details regarding construction of the cartridge seat assembly 110, including the cartridge seat 120 with the flexible tube 160 and fluid supply tubes 150*a-b* are shown. In the example shown, the cartridge seat 120 receives the fluid supply tubes 150 into a bottom or lower opening. The supply tubes 150 are mounted within a bracket 151 which can be affixed to the cartridge seat 120 via bolts 154. In the example shown, the bracket 151 includes gasket fittings 153*a-b* corresponding to fluid supply tubes 150*a-b,* and is received into the cartridge seat 120 to form a sealing connection when affixed via the bolts 154.

Figure 7:
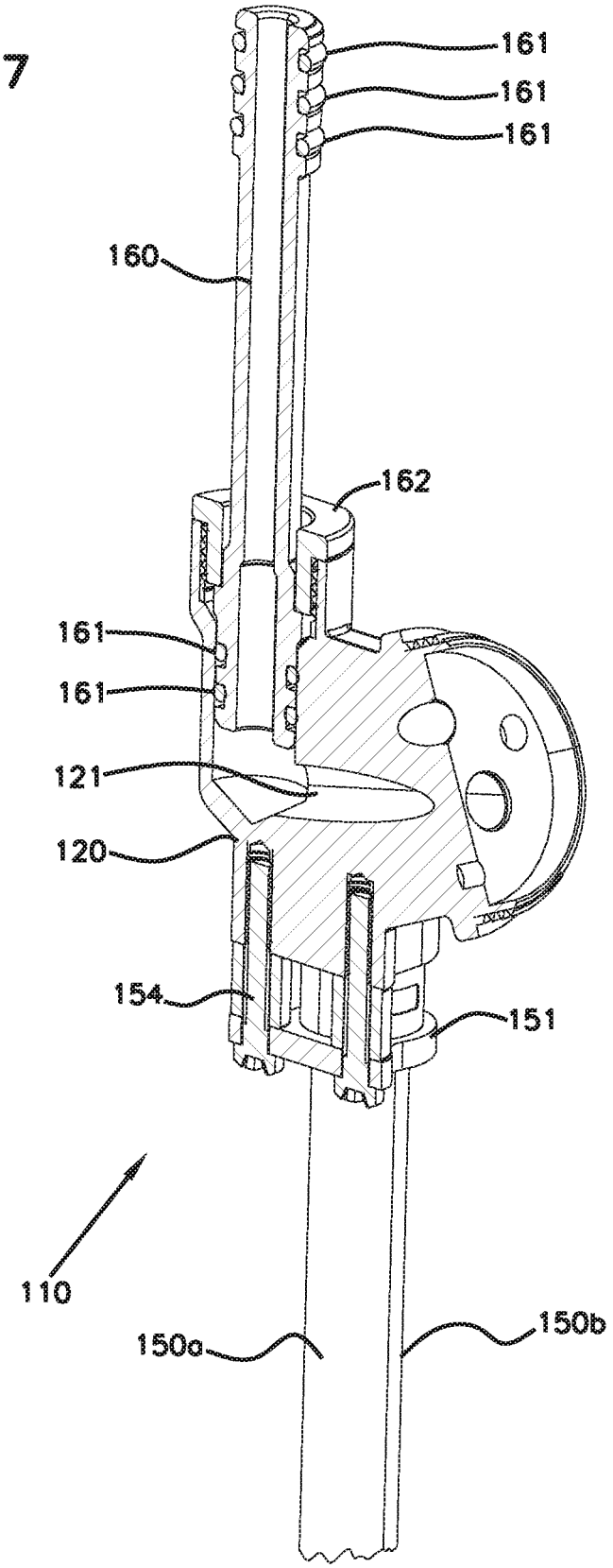
FIG. 7 is a cross-sectional perspective view of the example cartridge seat module of FIG. 5.

As seen in FIG. 7, when the cartridge seat assembly 110 is assembled with the flexible tube 160 and fluid supply tubes 150*a-b,* a fluid path is formed from the fluid supply tubes 150*a-b* into the cartridge seat 120, into openings that are aligned with a mounting location for the cartridge 122, and to a mixed fluid outlet path leading to the fluid outlet side 152 (and subsequently, the flexible tube 160, then the bearing 130 and spout 102 as previously described).

Figure 8:
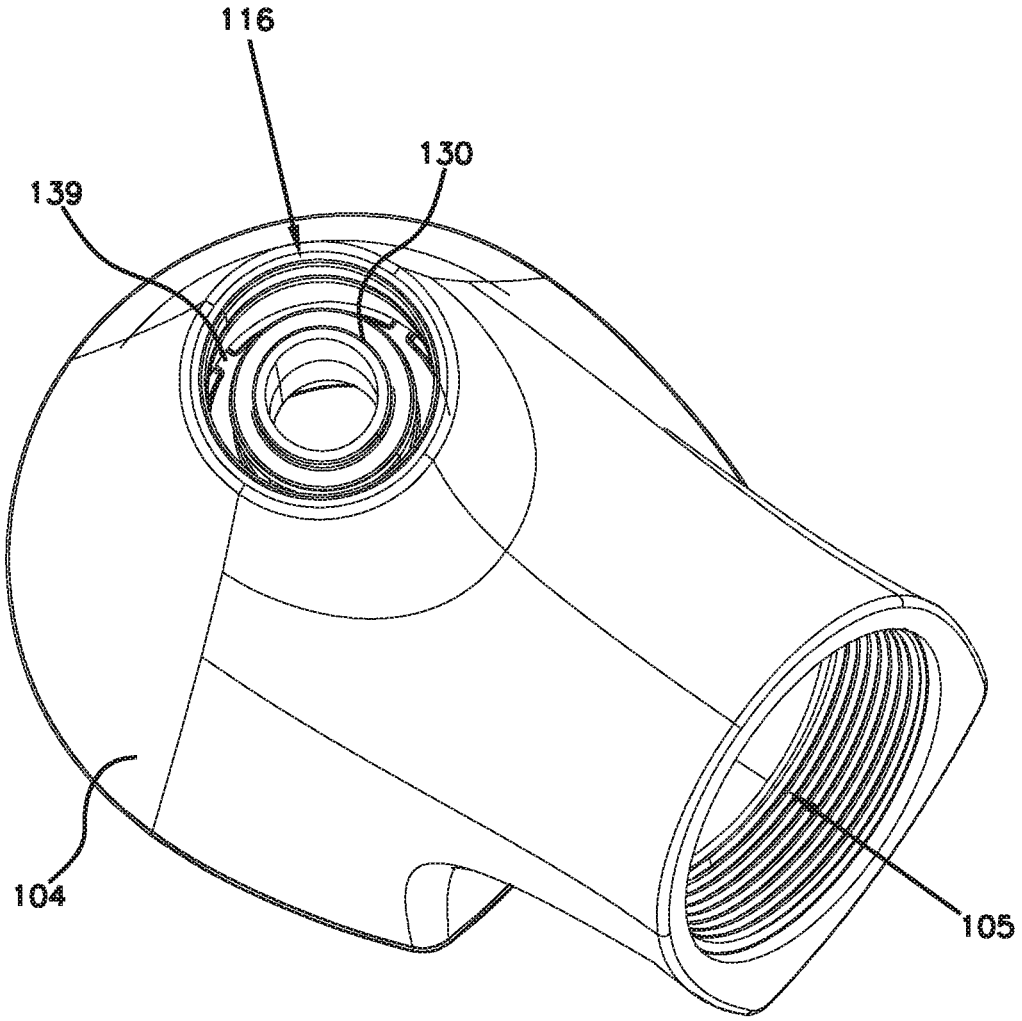
FIG. 8 is a top perspective view of a spout bearing usable within the faucet of FIG. 1.

As seen in FIGS. 8-12, additional details regarding construction of and installation of the bearing 130 and spout 102 into the faucet body 104 are provided. As seen in FIG. 8, when installed within the faucet body 104, the bearing 130 is exposed at the mounting channel 116. The spout 102 may be installed after installation of the bearing 130, and retained by the expandable retaining clip 140. In particular, and as seen in FIGS. 8-9, as the bearing 130 is affixed in place within the faucet body 104 by the threaded collar 132, the bearing 130 is pressed upward (toward the opening of the mounting channel 116) against a flange 137. The bearing 130 includes a plurality of ridges 139 on a flanged section that engage with recesses in the flange 137 to prevent rotation of the bearing 130 if and when the spout 102 is rotated relative to the faucet body 104.

Figure 12:
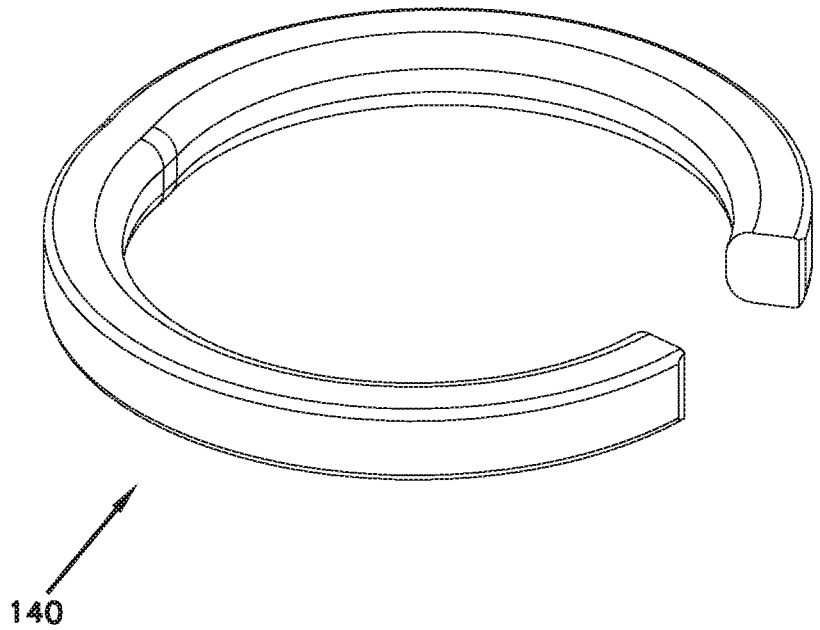
FIG. 12 is a perspective view of a retaining clip usable to retain a spout to a faucet body within the faucet of FIG. 1.

Once the bearing 130 is installed within the faucet body 104, the spout 102 may be attached by inserting a portion of the spout 102 at the mounting channel 116. When inserted, the spout 102 may have the retaining clip 140 and o-ring 142 installed thereon, with the retaining clip 140 in a compressed state. Once inserted, the retaining clip may spring into an expanded state (e.g., as seen in FIG. 12) such that it resides within a channel in the faucet body 104 as well as the existing channel in the spout 102 (as seen in FIG. 4), thereby retaining the spout 102 to the faucet body 104 in a pivotable fashion.

Referring to FIGS. 1-12 generally, it is noted that the present construction of a faucet provides a number of advantages over existing faucet constructions. For example, use of a flexible conduit connecting the cartridge location to the spout, a wetted spout faucet can be easily constructed that automatically accommodates variances in manufacturing that may result in different positioning of the cartridge 122, cartridge seat 120, and spout 102. Still further, because that flexible tube remains within the faucet body (e.g., rather than being routed below the sink and back up through a wetted spout tube), the faucet body construction may be made significantly more compact and with less materials, resulting in a lower overall cost of materials as well as greater flexibility in design of the faucet. Still further, the construction as illustrated can accommodate various other variations to the cartridge construction, e.g., mounting of the cartridge at other positions, or mounting of more than one cartridge to the faucet body (e.g., by using an appropriate cartridge seat assembly).

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the present invention, disclosure, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The above specification, examples and data provide a complete description of the manufacture and use of the composition of the invention. Since many embodiments of the invention can be made without departing from the spirit and scope of the invention, the invention resides in the claims hereinafter appended.

What is claimed:

1. A faucet comprising:

a faucet body;

a spout bearing attached to the faucet body and including an interior ramped surface;

a spout attached to the faucet body via the spout bearing and extending from the faucet body along an axis, the spout having an interior defining a fluid path;

a cartridge seat positioned within the faucet body, the cartridge seat having a fluid inlet and a fluid outlet;

a valve cartridge positioned offset from the axis and contacting the cartridge seat, the valve cartridge being fluidically connected to the cartridge seat, forming a fluid path between the fluid inlet and the fluid outlet; and a flexible tube fluidically connected between the fluid outlet of the cartridge seat and the spout, the flexible tube being positioned entirely within a cavity formed by the faucet body and the spout, wherein the interior ramped surface forms an entry point at which the flexible tube is inserted within the spout bearing.

2. The faucet of claim 1, wherein the spout bearing is attached to the interior of the spout.

3. The faucet of claim 1, wherein the spout bearing is attached to an outside of the spout.

4. The faucet of claim 1, wherein the spout bearing is attached to the faucet body by a threaded retainer ring.

5. The faucet of claim 1, wherein the spout bearing includes one or more ridges, the one or more ridges fitting into one or more recesses in the faucet body and preventing rotation of the spout bearing.

6. A cartridge seat assembly comprising:

a cartridge seat configured to be attached to a faucet body and a valve cartridge;

one or more inlet lines attached to an inlet of the cartridge seat;

a spout bearing; and a flexible tube having a first end attached to an outlet of the cartridge seat, and a second end of the flexible tube configured to be slidably attached within the spout bearing coupled to a faucet spout, wherein the spout bearing includes a lead in angle to accept the flexible tube, and wherein the flexible tube is configured to be entirely within the faucet body.

7. The cartridge seat assembly of claim 6, wherein the spout bearing forms a dynamic seal to the faucet spout, the faucet spout rotatably attached to the faucet body.

8. The cartridge seat assembly of claim 7, wherein the spout bearing is attached to the faucet body by a threaded retainer ring.

9. The cartridge seat assembly of claim 7, wherein the spout bearing includes one or more ridges, the one or more ridges fitting into one or more recesses in the faucet body and preventing rotation of the spout bearing.

10. A faucet comprising:

a faucet assembly comprising:

a substantially vertically oriented faucet body;

a valve cartridge mounted within the faucet body and oriented along a non-vertical axis; and a rigid spout rotatably attached to the faucet body, the rigid spout having an interior defining a fluid path; and a cartridge seat assembly comprising:

a cartridge seat configured to be attached to the faucet body and the valve cartridge;

one or more inlet lines attached to an inlet of the cartridge seat;

a flexible tube having a first end attached to an outlet of the cartridge seat and a second end in fluid communication with the rigid spout, wherein the entire flexible tube is within the faucet body; and a spout bearing, wherein the spout bearing forms a sealing engagement to the interior of the rigid spout and is configured to receive the flexible tube, and wherein the spout bearing has a ramped surface positioned at a lowermost opening to accept the flexible tube.

11. The faucet of claim 10, wherein the flexible tube forms a sealing connection to the spout bearing.

12. The faucet of claim 10, wherein the spout bearing is attached to the faucet body by a threaded retainer ring.

13. The faucet of claim 10, wherein the spout bearing includes one or more ridges, the one or more ridges fitting into one or more recesses in the faucet body to inhibit rotation of the spout bearing.

14. A faucet comprising:

a faucet body;

a spout attached to the faucet body at a mounting channel and extending from the faucet body along a first axis, the spout having an interior defining a fluid path;

a cartridge seat positioned within the faucet body, the cartridge seat having a fluid inlet and a fluid outlet;

a valve cartridge positioned offset from the first axis and contacting the cartridge seat, the valve cartridge being fluidically connected to the cartridge seat, forming a fluid path between the fluid inlet and the fluid outlet;

a spout bearing positioned within the faucet body, the spout bearing having a lead in angle at a lowermost opening; and a flexible tube extending generally linearly between the fluid outlet of the cartridge seat and the spout bearing in a direction toward the mounting channel and fluidically connecting the fluid outlet of the cartridge seat to the spout.

15. The faucet of claim 14, wherein the spout bearing forms a dynamic sealing engagement to the interior of the spout, and wherein the spout is rotatably attached to the faucet body.

* * * * *